US005308245A

United States Patent [19]

Constantino

[11] Patent Number: 5,308,245

[45] Date of Patent: May 3, 1994

[54] KIT AND METHOD FOR FACILITATING STOPPING SMOKING

[75] Inventor: Joseph A. Constantino, Strongsville, Ohio

[73] Assignee: Gat-A-Grip Enterprises, Strongsville, Ohio

[21] Appl. No.: 938,277

[22] Filed: Aug. 31, 1992

[51] Int. Cl.[5] ..... G09B 19/00

[52] U.S. Cl. ..... 434/236

[58] Field of Search ..... 434/236; 482/49; 131/270, 329

[56] References Cited

U.S. PATENT DOCUMENTS

| | | | |
|---|---|---|---|
| 3,655,325 | 4/1972 | Toppel | 434/236 X |
| 4,105,200 | 3/1977 | Unger | 482/49 X |
| 4,246,913 | 1/1981 | Ogden et al. | 434/236 X |
| 4,344,625 | 8/1982 | Frudakis | 273/242 |
| 4,440,396 | 4/1984 | Frudakis | 273/242 |
| 4,615,681 | 10/1986 | Schwartz | 434/236 |
| 4,692,118 | 9/1987 | Mould | 434/236 |
| 4,717,343 | 1/1988 | Densky | 434/236 |
| 4,734,037 | 3/1988 | McClure | 434/236 |
| 4,788,189 | 11/1988 | Glazer . | |
| 4,881,554 | 11/1989 | Obasogie . | |
| 4,911,181 | 3/1990 | Vronsen et al. . | |
| 4,926,573 | 5/1990 | Hetrick | 131/270 X |
| 4,951,691 | 8/1990 | Leary | 131/270 |

FOREIGN PATENT DOCUMENTS

| | | | |
|---|---|---|---|
| 1162314 | 8/1969 | United Kingdom | 434/236 |

*Primary Examiner*—John G. Weiss
*Assistant Examiner*—Jeffrey A. Smith
*Attorney, Agent, or Firm*—Renner, Otto, Boisselle & Sklar

[57] ABSTRACT

A kit for facilitating a person stopping smoking includes a resilient, manually graspable tactile device or grip that is about the shape and size of a usual pack of cigarettes that fits into the hand of a person, and inducement means for inducing a person to use the tactile means and for instructing the person in the use of the kit, the inducement means may include prerecorded audio material and/or printed material. A method to facilitate a person stopping smoking includes holding a tactile means is one hand, squeezing the tactile means until a burning sensation is experienced in the forearm, releasing the tactile means, changing hands and repeating the foregoing steps until the desire to smoke a cigarette decreases to a controllable level.

6 Claims, 1 Drawing Sheet

KIT AND METHOD FOR FACILITATING STOPPING SMOKING

TECHNICAL FIELD

The present invention relates generally, as is indicated, to an apparatus and method for helping an individual to stop the habit of smoking and, more particularly, to a kit and a method to facilitate stopping smoking by substituting effort to squeeze a tactile member for the desire or urge to smoke a cigarette.

BACKGROUND

Various techniques have been used to help a person quit the habit of smoking, especially of smoking cigarettes. One of the most common techniques uses oral substitution in which gum, hard candy, toothpicks, unlit cigarettes, and artificial cigarettes are placed in or held by the mouth of the person rather than smoking a cigarette. Various disadvantages occur with each of those oral substitutes. For example, it often is unprofessional looking to have gum, candy, toothpick, or other item in or held by the mouth, especially when speaking in a formal setting. Gum and candy can be injurious to the teeth and also can cause weight increase. Toothpicks often can be dangerous. Unlit cigarettes too easily present a temptation for lighting. Artificial cigarettes are expensive and are too similar to real cigarettes so that the hand and mouth actions associated with their use allow the person to continue with the habits generally associated with actual cigarette smoking; and, a result, it can be too easy to fall back into the habit of actual cigarette smoking.

The disadvantages to cigarette smoking are many. Examples of such disadvantages are potential injury to the person's own health, creation of displeasure and possibly health hazard to nearby individuals who do not smoke but inhale secondary smoke, depositing odor on clothing, on room walls and furniture, etc.

The present invention is directed to a kit and to a method to facilitate a person (sometimes referred to herein as a patient) stopping smoking, especially smoking of cigarettes, but also of smoking other items, such as cigars, pipes, etc. The invention also may be used for stopping another type of habit or changing certain behavior; but, as will be described in detail below, the invention is particularly suitable to facilitating the stopping of smoking cigarettes. The invention uses a manual tactile approach in which a tactile means is squeezed when there is a desire or urge to smoke a cigarette.

Various tactile devices intended to be grasped manually, i.e., by the hand of a person, are available commercially. One such device is made of a resilient polymer or foam material that can be grasped in a single hand and can be squeezed deforming the device under the force or pressure of the squeezing hand. The device regains its original shape when the applied force or pressure is relieved partially or fully, depending on the precise nature of the device. On some such device slots or slot-like zones are provided to position the fingers relative to the device and a relatively smooth surface fits against the palm of the hand as the fingers are closed in the slots on the device to apply the force or pressure to cause the mentioned deformation. Another commercially available device includes metal spring material located between a pair of handle portions. The handle portions can be held in the hand of a person and can be squeezed toward each other against the force exerted by the spring material as the person's hand is closed. The aforementioned devices are intended to increase strength, build muscle, etc. Other devices that provide such functions also may be available.

In the past psychological and quasi-psychological approaches have been used to help a person stop smoking. One example is an organization called "Smokers Anonymous", which is a help group in which individuals encourage others to stop smoking and in doing so provide self-encouragement. Also, some individuals actually visit psychologists and psychiatrists to assist them in quitting smoking. Each of these psychological or quasi-psychological procedures requires specific appointments and time scheduling which may be fairly irrelevant to the actual times when a desire to smoke a cigarette occurs to an individual. Scheduling of the appointments may be an inconvenience; the time at which the appointments are scheduled may be inconvenient; and a particular appointment may not be helpful with regard to an urge to smoke a cigarette occurring on a different day or at a different time.

The present invention provides self-help, encouragement, and inducement of a person or patient to use the tactile means and method when there is a desire to smoke a cigarette, whereby the urge is in a sense dissipated through the act of squeezing or otherwise applying force to the tactile means. The encouragement or inducement is provided in various media. One example is printed material in a booklet or other form. Another example is a tape recording that can be played by the person to receive encouragement and inducement to use a tactile means and to quit smoking. Other media also may be used to provide the encouragement and/or inducement information, such as a compact disc, video disc, videotape, floppy disc, etc., and appropriate play back means (e.g., a disc player, vcr, computer, etc.) may be used to play the information stored in the medium to the user.

BRIEF SUMMARY OF THE INVENTION

Briefly, according to the present invention, a kit for facilitating a patient or person stopping smoking includes a tactile device for manual grasping by a patient and an inducement means to induce or to encourage a patient to use the tactile device and to instruct the patient in such use of the tactile device and the overall kit.

Also, according to the invention, a method to facilitate a patient stopping smoking includes the steps of holding a tactile device in one hand, squeezing the tactile device until a burning sensation is experienced in the forearm, and then releasing the tactile device.

The foregoing and other objects, features, aspects, advantages and details of the present invention will become more apparent from the following description. It will be appreciated that although a preferred embodiment of the invention is described, the scope of the invention is to be determined by the claims and equivalents thereof.

To the accomplishment of the foregoing and related ends, the invention, then, comprises the features hereinafter fully described in the specification and particularly pointed out in the claims, the following description and the annexed drawing setting forth in detail an illustrative embodiment of the invention, this being indicative, however, of but one of the various ways in which the principles of the invention may be suitably employed.

DESCRIPTION OF THE PREFERRED EMBODIMENT

Figure 1:
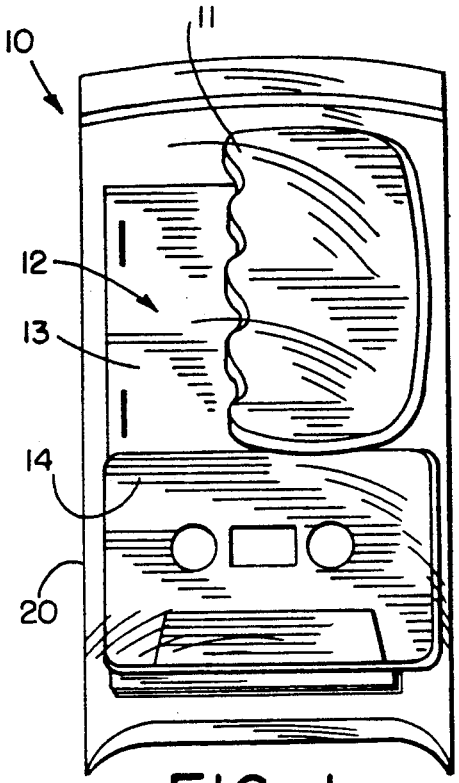
FIG. 1 is a schematic view of a kit for facilitating a patient stopping smoking in accordance with the present invention, including a tactile device for manual grasping by a patient and a means to induce the patient to use the tactile means and to instruct the patient in the method of the invention.

Referring, now, in detail to the drawing, wherein like reference numerals designate like parts in the several figures, and initially to FIG. 1, a kit in accordance with the present invention is shown at 10. The kit 10 includes a tactile device 11 and media 12 in which is contained information concerning the technique for using the tactile device 11 and information to encourage or to induce the person who is using the invention to quit smoking. In the illustrated embodiment of the invention, the media 12 includes a printed medium 13 in the form of a booklet and a magnetic recording medium 14 in the form of a cassette of magnetic tape that can be played in a conventional appropriate size tape player or tape deck. Other forms of media also may be used, such as floppy disc, optical disc, solid state memory, and other forms of media. More or fewer than two forms of media may be included in the kit 10. Preferably the kit 10 includes one form of media that can be read visually for those individuals who prefer reading to listening or viewing and another form of media that can be viewed or listened to for those who prefer not to read. However, preferably the information in the several forms of media is identical or substantially identical.

Figure 2:
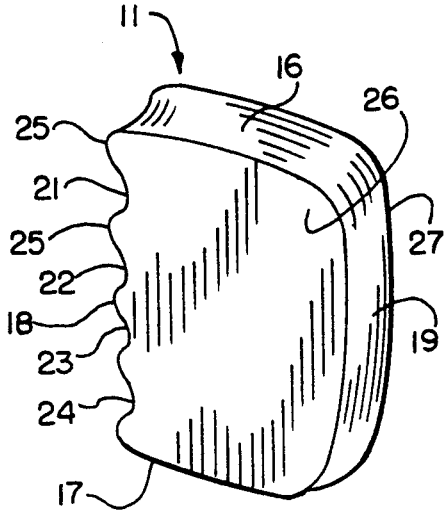
FIG. 2 is an isometric view of a tactile means in accordance with the present invention.

The tactile device 11 is illustrated in detail in FIG. 2. Preferably it is made of a resilient form or foam-like material, polymer material, rubber or the like. It is of a size from top 16 to bottom 17 and width from front 18 to back 19 as well as thickness that can be held easily in the hand of an adult, although it can be of other sizes, as may be desired. Preferably the tactile device 11 is of a height that is approximately the height of a hand, i.e., the distance from the smallest (pinky) finger approximately to the index finger. The tactile device 11 alternatively may be larger or smaller. Larger devices 11 can have different shapes at different locations for variety and to provide additional manipulation interest to the user. Smaller devices 11 also may be used as long as they provide adequate material that can be held firmly by the hand of a person.

The tactile device 11 preferably is resilient, devices 11 that are less resilient or even not resilient at all also may be used in accordance with the invention provided that they afford the ability to be grasped manually and held securely to practice the invention in the manner described herein. The back edge or surface 19 of the tactile device 11 is of a size and shape to rest comfortably against and in the palm of the hand of a user. A number of slot-like recesses or low area zones 21, 22, 23, 24 at the front 18 of the device are provided for the individual fingers of a hand easily to be positioned or located for secure grasping of the device 11. The recesses 21–24 are located between a number of raised or relatively raised zones or lands 25 so that there are a series of raised zones and recessed zones to guide the fingers into position at respective locations on the device in the manner illustrated in FIG. 3. With such arrangement, the device 11 easily can be grasped and held securely in the hand of the person using the device according to the invention. Other forms of the device may be used. For example, the raised and recessed zones may be eliminated and the front 18 may be smooth. Stippling may be on the back and/or front 18, 19 or elsewhere to provide additional friction facilitating secure holding of the device. Various other formations may be placed in the top or bottom or elsewhere. Also, the front and back faces generally designated 26, 27 may be flat, contoured, curved, or otherwise formed, as may be desired.

Preferably, the device 11 is resilient and can be squeezed securely by the hand of a person. Then upon release of the pressure asserted against the device 11 during such squeezing, the device will tend to regain its original shape. Such devices are commercially available.

Other equivalent tactile devices also may be used to provide the desired resistance to deformation and squeezing, resilience, etc. in accordance with the invention. One non-limiting example is a spring-type device mentioned above in which two wires and/or handles are held at a fixed position by a spring wire or portion of the device, and those handles can be moved toward each other by application of suitable force or pressure.

The tactile device 11 preferably is of a size that is about the same as the size of a package of cigarettes. In this case it can be carried by a person in the same way and location, e.g., in a shirt, jacket, or pants pocket, purse, etc., that the person ordinarily would have carried cigarettes. The printed medium 13, such as a booklet, also preferably is of approximately the size to be able to fit into that same location together with the tactile device 11. Therefore, when the person might reach for cigarettes according usual custom or habit, the tactile device, and, if also used, the booklet 13, would be grasped rather than the cigarette package-another quasi-psychological advantage of the present invention whereby the person is reminded of the intention to stop the smoking habit. The booklet 13 then can be read for encouragement to stop smoking, and the tactile device can be used to dissipate the desire to smoke.

The kit 10 includes a package or container 20 for containing the two primary portions of the invention, namely the tactile device 11 and the media 12. The package 15 may be plastic or other bag, box or carton, a combination thereof, such as those known as blister packs, etc. It is desirable that the various parts, i.e., the tactile device 11 and the media 12, especially the booklet 13, of the kit 10 be sold and used together so that the person using the invention will know how to use the tactile device 11, having gained that information from the media, and will continue to be encouraged in efforts to quit smoking by reading, hearing, seeing, etc., the information that provides encouragement and inducement from the media.

Although the addiction to nicotine often can be broken by a person, the addiction to the habit of smoking often is more difficult to break. With the tactile device of the invention being of a size approximately that of a package of cigarettes, such device will tend to replace the package of cigarettes when the habit causes a person to reach for that package. Upon grasping the tactile device rather than the package of cigarettes, the individual's desire to stop smoking is re-kindled, and the method of the invention using the tactile device can be further carried out.

The tactile device 11 thus provides a substitute for the package of cigarettes. The tactile device 11 also provides the person something to do with the hands without having to put something in the mouth, thus avoiding the problems associated with oral substitutes mentioned above. Moreover, use of the tactile device 11 by tightening and relaxing the muscles of the hand and arm tends to provide a relaxation function reducing possible tension that may occur in the user when a desire to smoke a cigarette occurs.

The media materials 12 preferably provide the foregoing information concerning smoking, disadvantages to smoking, disadvantages to other techniques to stop smoking, advantages to using the present invention to stop smoking, other types of encouragement information and information to induce or to provide inducement to a person to practice the invention and to stop smoking, and specific instructions on the use of the tactile device 11. The media materials 12 also may include other information, for example information consistent with the present invention.

When using the tactile device 11, a person would take hold of the device so that it feels comfortable in the hand. The device can be manipulated by the hand until it does feel comfortable. By changing the manner in which the device 11 is held, different muscles in the hand or arm will be used to squeeze the device 11, and the person can determine whether a specific set of muscles is most desired or whether using a variety of muscles is more desirable and effective for the person. In the latter case, the device 11 may be held in different positions in the hand on each different occasion that the device 11 is used to overcome a desire to smoke a cigarette or in different positions as the device is used to overcome a single time occurrence of the desire to smoke a cigarette.

Figure 3:
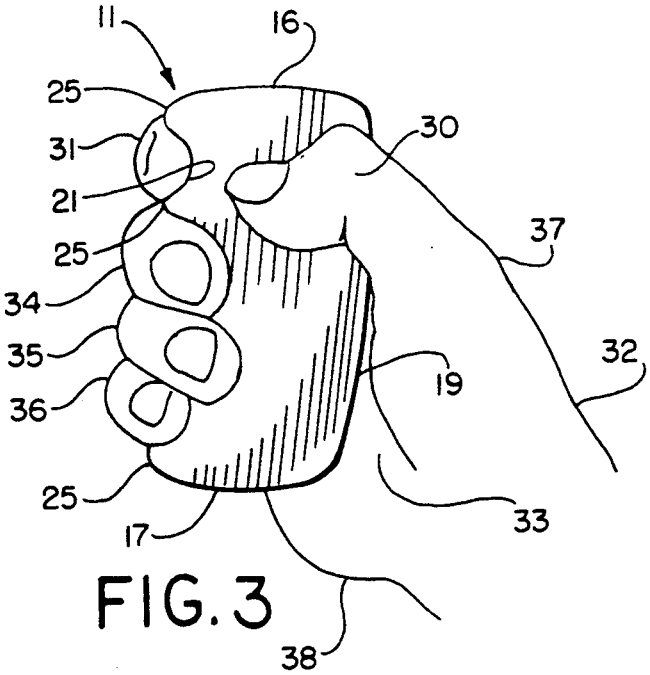
FIG. 3 is a schematic fragmentary view showing a person using the tactile means in accordance with the invention.

An exemplary suitable position for manually grasping the device 11 is to try to keep the thumb substantially even, e.g., in a parallel plane, with the index finger. An example of such use position is shown in FIG. 3 where the thumb 30 and index finger 31 of the hand 32 are approximately in the same plane. The back 19 of the device 11 is facing the palm 33 of the hand 32, and the respective fingers 31, 34, 35, 36 are located in respective recesses 21, 22, 23, 24 at the front 18 of the device 11. The top 16 and bottom 17 of the device 11 extend beyond the top 37 and bottom 38 of the hand to give an idea of the size of the device 11. However, the height of the device 11 (and other dimensions, as well, as was mentioned above) can be larger or smaller than the device illustrated in the drawings, e.g., relative to the hand 32.

While the tactile device 11 is held in one hand, the person squeezes it as hard as possible for approximately one minute or until a burning sensation or a tired and uncomfortable sensation is felt in the forearm. The person then releases the device and places it in the opposite hand. The device again is squeezed by the second hand until the burning or tired and uncomfortable sensation is felt in the forearm of that hand. These steps are repeated until the desire to smoke a cigarette is gone. It has been found that after several repetitions, e.g., from as few as one to five or more, repetitions of squeezing with respective hands, the desire to smoke a cigarette on the current occasion usually ends.

In contrast to conventional exercise programs, use of the tactile device 11 according to the invention does not intend for the device to be squeezed and released immediately following the squeezing action. Rather, the action using the device 11 according to the present invention is to apply a squeezing force without releasing until there is the burning or tired and uncomfortable feeling in the forearm, a rather different action than the typical squeeze/release, squeeze/release action of prior exercise programs.

It may be that hard or strong squeezing of the device 11 causes an immediate discomfort, as opposed to the tired and uncomfortable feeling mentioned after squeezing for a fairly long time. Should this be the case, the force with which the device 11 is squeezed should be reduced, and over time, e.g., after a number of uses of the device 11 to overcome respective urges to smoke a cigarette, the strength or hardness of the squeeze can be gradually built up. Regardless of how the tactile device 11 is used, though, it is important that it be used each time there is an urge or desire to smoke a cigarette instead of smoking the cigarette.

It has been found that when a person has decided to quit smoking, use of the tactile device 11 and medium 12 on each occasion there is a desire to smoke, eliminates the then current desire. Repeated use of the kit 10 and parts thereof and practicing of the method of the invention has been found useful to help individuals quit smoking. Moreover, even if the habit of smoking has been substantially eliminated, it is possible conveniently to carry the parts of the kit, e.g., the tactile device 11 and medium 12, so that should there be a future desire to smoke, the invention can be practiced until that desire is gone. Indeed, the invention can be practiced virtually at any time and any place under any condition. Non-limiting examples include while driving or riding in a vehicle, talking on the phone, watching a movie, standing, seated, after or even during a meal, etc.

I claim:

1. A kit for facilitating a person stopping smoking, comprising tactile means for manual grasping by a person, and inducement means for inducing a person to use the tactile means and for instructing the person in the use of the kit, and said inducement means comprising means for encouraging the person to use the tactile means as a substitute for smoking.

2. A method to facilitate a person stopping smoking, comprising holding a tactile means in one hand, squeezing the tactile means until a burning sensation is experienced in the forearm, releasing the tactile means, and further comprising repeating the foregoing steps until the desire to smoke a cigarette decreases to a controllable level.

3. A method to facilitate a person stopping smoking, comprising holding a tactile means in one hand, squeezing the tactile means until a burning sensation is experienced in the forearm, releasing the tactile means, and further comprising repeating the foregoing steps until the desire to smoke a cigarette at that time is gone.

4. The method of claim 3, further comprising after the burning sensation is experienced in one forearm repeating the foregoing steps for the other hand; and continuing to repeat said steps until the desire to smoke a cigarette at that time is gone.

5. A method to facilitate a person stopping smoking, comprising holding a tactile means in one hand, squeezing the tactile means until a burning sensation is experienced in the forearm, releasing the tactile means, and further comprising reviewing inducement material for encouragement to use the tactile means and to perform the foregoing steps as a substitute for smoking a cigarette.

6. A method to facilitate a person stopping smoking, comprising holding a tactile means in one hand, squeezing the tactile means until a burning sensation is experienced in the forearm, releasing the tactile means.

wherein the tactile means is resilient and of a size to fit in one hand, and said squeezing comprises squeezing the resilient means to change the shape thereof and maintaining a secure hold and squeeze pressure on the resilient means until the burning sensation is experienced in the forearm of the hand doing the squeezing, and further comprising repeating the foregoing steps until the desire to smoke a cigarette at that time is gone.

* * * * *